US009293872B2

(12) United States Patent
Mikli

(10) Patent No.: US 9,293,872 B2
(45) Date of Patent: Mar. 22, 2016

(54) CABLE CONNECTOR, ADAPTER ASSEMBLIES AND RELATED SYSTEMS AND METHODS

(71) Applicant: Tyco Electronics Raychem GmbH, Ottobrunn (DE)

(72) Inventor: Norbert Mikli, Ebersberg (DE)

(73) Assignee: Tyco Electronics Raychem GmbH, Ottobrunn (DE)

( * ) Notice: Subject to any disclaimer, the term of this patent is extended or adjusted under 35 U.S.C. 154(b) by 187 days.

(21) Appl. No.: 13/944,997

(22) Filed: Jul. 18, 2013

(65) Prior Publication Data

US 2014/0024268 A1 Jan. 23, 2014

Related U.S. Application Data

(60) Provisional application No. 61/672,927, filed on Jul. 18, 2012.

(51) Int. Cl.

| | |
|---|---|
| ***H01R 13/53*** | (2006.01) |
| ***H01R 24/20*** | (2011.01) |
| ***H01R 11/12*** | (2006.01) |
| ***H01R 13/631*** | (2006.01) |
| *H01R 101/00* | (2006.01) |

(52) U.S. Cl.

CPC ..... *H01R 24/20* (2013.01); *H01R 11/12* (2013.01); *H01R 13/6315* (2013.01); *H01R 13/53* (2013.01); *H01R 2101/00* (2013.01)

(58) Field of Classification Search

USPC ..... 439/181, 921, 912

IPC ..... H01R 13/53,13/6485, 13/6666, 13/5205, H01R 2101/00

See application file for complete search history.

(56) References Cited

U.S. PATENT DOCUMENTS

| | | | | |
|---|---|---|---|---|
| 4,161,012 | A * | 7/1979 | Cunningham | 361/128 |
| 4,865,559 | A | 9/1989 | Clabburn | |
| 6,726,510 | B2 | 4/2004 | Norbert et al. | |
| 7,059,879 | B2 * | 6/2006 | Krause et al. | 439/181 |
| 7,168,983 | B2 | 1/2007 | Graf et al. | |
| 7,331,806 | B2 * | 2/2008 | Stagi et al. | 439/204 |
| 8,043,102 | B2 * | 10/2011 | Lu et al. | 439/181 |
| 8,454,376 | B1 * | 6/2013 | Siebens | 439/181 |
| 8,602,800 | B2 * | 12/2013 | Borgstrom et al. | 439/181 |

FOREIGN PATENT DOCUMENTS

EP 0 087 267 8/1983

OTHER PUBLICATIONS

Raychem screened, separable connection system RSTI-68 800 A up to 42 kV, Tyco Electronics, available prior to Jul. 18, 2013.

* cited by examiner

*Primary Examiner* — Hien Vu
(74) *Attorney, Agent, or Firm* — Myers Bigel & Sibley, PA

(57) ABSTRACT

An adapter assembly includes an adapter body and a connector. The adapter body has a main leg and a cross leg. The main leg and cross leg have intersecting passages. The connector includes: an electrically conductive semi-flexible joint having first and second opposed joint ends; a first end portion on the first joint end, with the first end portion including a body configured to mechanically and electrically couple with an electrical conductor; and a second end portion on the second joint end, with the second end portion including a head configured to directly or indirectly electrically connect the semi-flexible joint to a termination of electrical equipment. The head is disposed in the cross leg passage and the semi-flexible joint is disposed in the main leg passage. The semi-flexible joint is configured to enable limited movement of the head relative to the cross leg passage.

19 Claims, 19 Drawing Sheets

CABLE CONNECTOR, ADAPTER ASSEMBLIES AND RELATED SYSTEMS AND METHODS

RELATED APPLICATIONS

This application claims priority to U.S. Provisional Patent Application No. 61/672,927, filed Jul. 18, 2012, the disclosure of which is incorporated by reference herein in its entirety.

BACKGROUND

It is known to provide an inline, L-shaped or T-shaped adapter to connect a high voltage cable (e.g., one rated at above about 1 kV) to a transformer, for example. The adapter usually has one inwardly-tapering socket in one arm thereof that is a push fit on to a bushing of the transformer, and receives the stripped or terminated end of the cable in another arm aligned with or at right angles thereto. The socket has an electrical contact (male or female) for cooperating with the contact (respectively female or male) of the bushing. The cable may be a push-fit into said other arm, or it may be connected externally of the adapter to a terminal that is molded thereinto, as disclosed in European Patent Application Publication No. 87267. Other adapters, usually of T-shape, have the bushing and cable arms at right angles to each other, and a further arm with a socket aligned with the bushing arm. Such further arm is closed by a removable plug that may allow access to connect the cable mechanically and electrically to the bushing.

With these known adapters, if it is necessary to disconnect the cable from the transformer, or to test or repair the cable or the transformer, the adapter has to be physically removed from the transformer bushing, carrying the cable with it, to ensure electrical isolation between the cable and bushing. This action can be difficult with larger diameter cables (e.g., greater than about 95 sq mm cross-section), and furthermore, can itself cause damage to the cable and/or the connector. Where electrical equipment other than a cable, for example switchgear, is to be connected, it is even more difficult and inconvenient to move the pieces of equipment relative to each other.

U.S. Pat. No. 4,865,559 describes an adapter that addresses some of these problems by allowing electrical interconnections without significantly affecting the mechanical interconnections between cables and electrical equipment.

Uses of these adapters by workers in the field are generally strictly regulated to provide worker safety in the presence of potentially high voltage signal lines. Such restrictions on use may be problematic, even when using adapters such as those disclosed in U.S. Pat. No. 4,865,559.

SUMMARY

According to embodiments of the present invention, an adapter assembly for connecting an electrical conductor to a termination of electrical equipment includes an adapter body and a cable connector. The adapter body has a main leg with a main leg passage defined therein and a cross leg with a cross leg passage defined therein. The main leg passage and the cross leg passage intersect. The cable connector includes an electrically conductive semi-flexible joint having first and second opposed joint ends. The cable connector includes a first end portion on the first joint end, with the first end portion including a body configured to mechanically and electrically couple with the conductor. The cable connector includes a second end portion on the second joint end, with the second end portion including a head configured to directly or indirectly electrically connect the semi-flexible joint to the termination. The head is disposed in the cross leg passage and the semi-flexible joint is disposed in the main leg passage. The semi-flexible joint is configured to enable limited movement of the head relative to the cross leg passage.

According to embodiments of the present invention, a cable connector for electrically connecting an electrical conductor to a termination of electrical equipment is configured to be mounted in an adapter body having a main leg with a main leg passage and a cross leg with a cross leg passage that intersects the main leg passage. The cable connector includes an electrically conductive semi-flexible joint having first and second opposed joint ends. The cable connector includes a first end portion on the first joint end, with the first end portion including a body configured to mechanically and electrically couple with the conductor. The cable connector includes a second end portion on the second joint end, with the second end portion including a head configured to directly or indirectly electrically connect the semi-flexible joint to the termination. The head is disposed in the cross leg passage and the semi-flexible joint is disposed in the main leg passage when the cable connector is mounted in the adapter body. The semi-flexible joint is configured to enable limited movement of the head relative to the cross leg passage when the cable connector is mounted in the adapter body.

According to embodiments of the present invention, an adapter assembly for connecting a cable to electrical equipment includes a T-shaped adapter and a cap. The T-shaped adapter includes an electrically insulating body, with the body including a main leg having a main leg passageway defined therein and a cross leg having a cross leg passageway defined therein that intersects with the main leg passageway. The cross leg has first and second opposite ends. The T-shaped adapter includes a first electrically conductive layer on an outer surface of the electrically insulating body. The first electrically conductive layer extends along an entire length of main leg. The first electrically conductive layer extends from the first end of the cross leg to an intermediate point between the first and second ends, thereby forming a gap without the first electrically conductive layer between the intermediate point and the second end. The cap is configured to fit over the second end of the cross leg. The cap includes an electrically insulating cap body and a second electrically conductive layer on an outer surface of the cap body. The second electrically conductive layer wraps around to an inner surface of the cap body such that the second electrically conductive layer is disposed on at least a portion of the inner surface. When the cap is mounted on the second end of the cross leg, the second electrically conductive layer on the inner surface of the cap body contacts the first electrically conductive layer on the cross leg.

Further features, advantages and details of the present invention will be appreciated by those of ordinary skill in the art from a reading of the figures and the detailed description of the preferred embodiments that follow, such description being merely illustrative of the present invention.

DETAILED DESCRIPTION OF EMBODIMENTS OF THE INVENTION

Figure 1A:
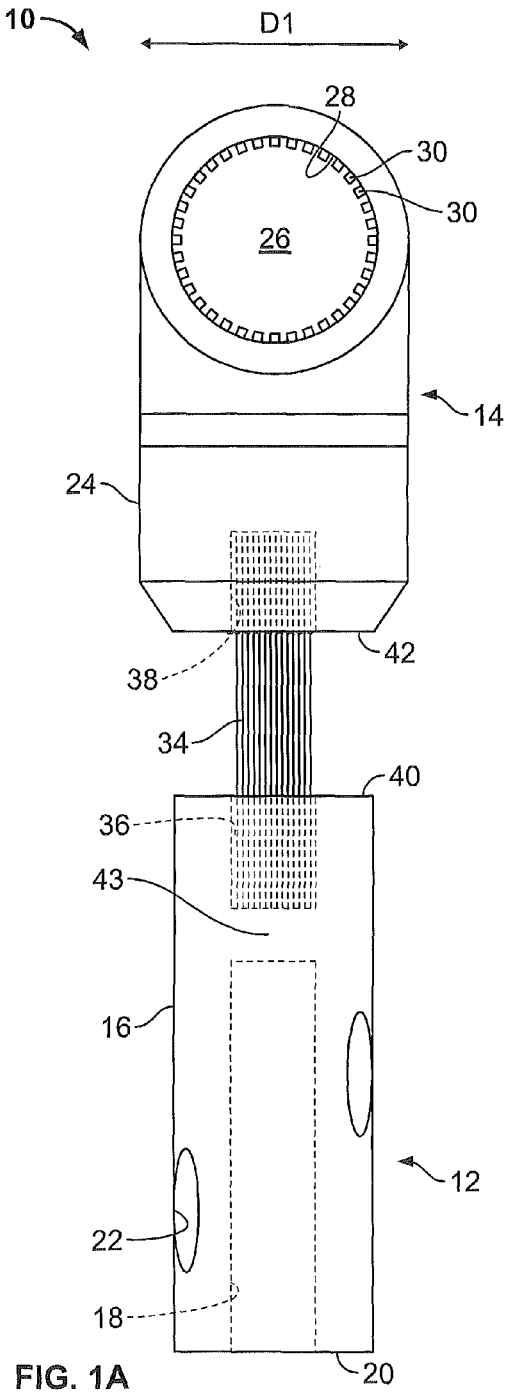
FIG. 1A is front view of a cable connector according to embodiments of the present invention.

The present invention now will be described more fully hereinafter with reference to the accompanying drawings, in which illustrative embodiments of the invention are shown. In the drawings, the relative sizes of regions or features may be exaggerated for clarity. This invention may, however, be embodied in many different forms and should not be construed as limited to the embodiments set forth herein; rather, these embodiments are provided so that this disclosure will be thorough and complete, and will fully convey the scope of the invention to those skilled in the art.

It will be understood that, although the terms first, second, etc. may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the present invention.

Spatially relative terms, such as "beneath", "below", "lower", "above", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90° or at other orientations) and the spatially relative descriptors used herein interpreted accordingly.

As used herein, the singular forms "a", "an" and "the" are intended to include the plural forms as well, unless expressly stated otherwise. It will be further understood that the terms "includes," "comprises," "including" and/or "comprising," when used in this specification, specify the presence of stated features, integers, steps, operations, elements, and/or components, but do not preclude the presence or addition of one or more other features, integers, steps, operations, elements, components, and/or groups thereof. It will be understood that when an element is referred to as being "connected" or "coupled" to another element, it can be directly connected or coupled to the other element or intervening elements may be present. As used herein, the term "and/or" includes any and all combinations of one or more of the associated listed items.

It is noted that any one or more aspects or features described with respect to one embodiment may be incorporated in a different embodiment although not specifically described relative thereto. That is, all embodiments and/or features of any embodiment can be combined in any way and/or combination. Applicant reserves the right to change any originally filed claim or file any new claim accordingly, including the right to be able to amend any originally filed claim to depend from and/or incorporate any feature of any other claim although not originally claimed in that manner. These and other objects and/or aspects of the present invention are explained in detail in the specification set forth below.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of this specification and the relevant art and will not be interpreted in an idealized or overly formal sense unless expressly so defined herein.

As used herein, "monolithic" means an object that is a single, unitary piece formed or composed of a material without joints or seams.

Figure 6A:
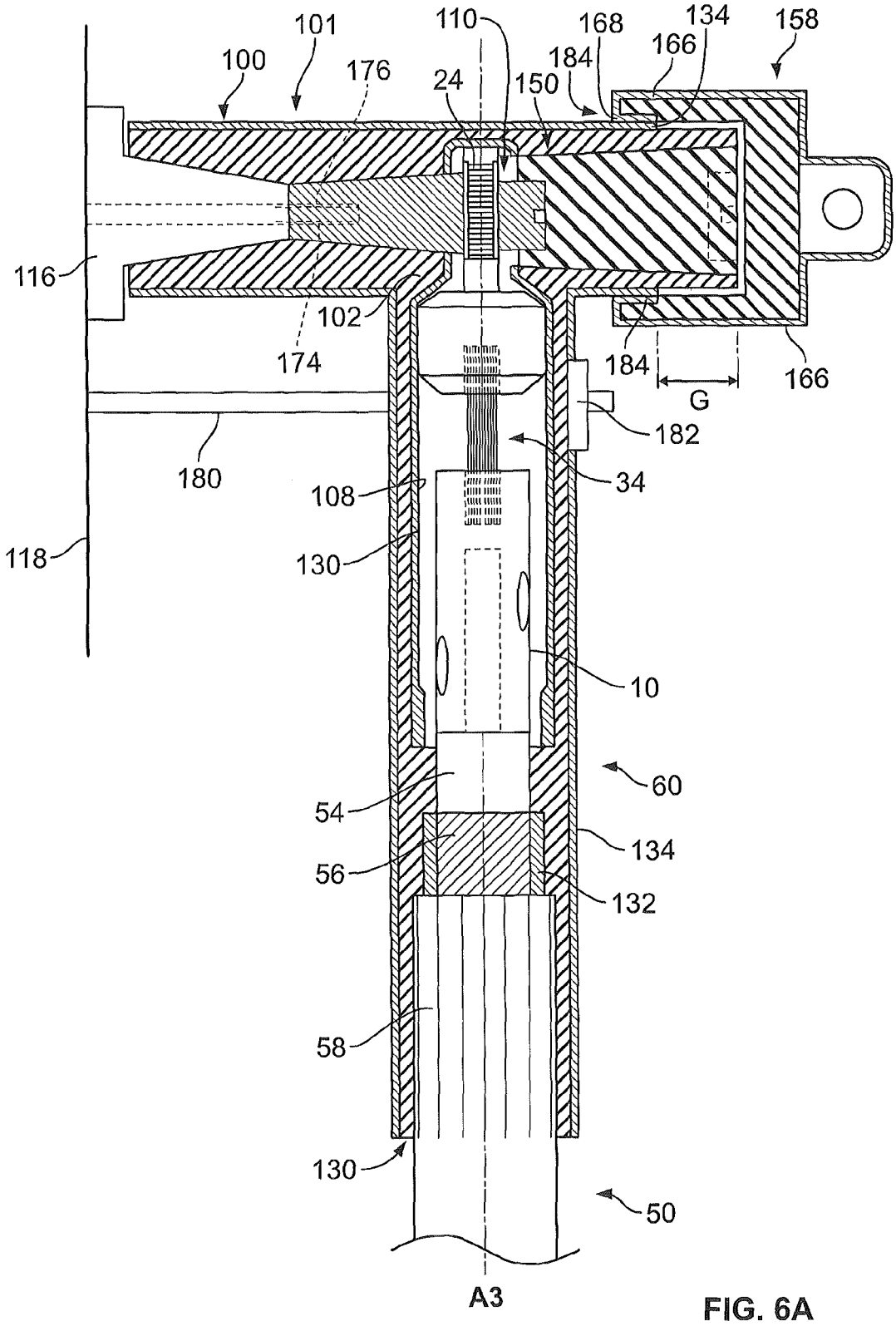
FIG. 6A is a fragmentary, sectional view of a cable connection system including the cable connector of FIGS. 1A and 1B according to embodiments of the present invention.

With reference to FIG. 6A, a cable connection system 101 according to some embodiments of the invention is shown therein. The cable connection system 101 includes an adapter body 100 and a cable connector 10. The cable connection system 101 may be used to terminate and environmentally protect an electrical cable 50 (in some embodiments, an electrical power transmission cable) and to enable physical and electrical connection between the cable 50 and a termination (e.g., a bushing 116) of associated electrical equipment 118, for example. The system 101 may include one or more alternative plug assemblies 150, 200, 212, 216 and 218 (FIGS. 7A-7D) that may be used to test and reconfigure the cable termination. The system 101 may also include a cap assembly 158.

The cable connector 10 is shown in FIGS. 1A and B. The connector 10 includes a first end portion 12 and a second opposite end portion 14.

The first end portion 12 includes a body 16. The body 16 may be formed of any suitable electrically conductive material such as steel, aluminum or copper. A conductor bore 18 is defined in the body 16 and extends axially inwardly from a first end 20 of the body 16. The conductor bore 18 defines a conductor bore axis A1. The conductor bore 18 is configured to receive a conductor of a cable along the axis A1. One or more radially extending, threaded bolt bores 22 are defined in the body 16. Each bolt bore 22 is configured to receive a threaded fastener 23 to secure the conductor in the conductor bore 18 (FIG. 3B). In some embodiments, the fasteners 23 are shear bolts, the heads of which will break off from the shanks when subjected to a prescribed torque. Alternatively, in some embodiments, the clamping bolt connector portion may be instead configured as a compression connector or other suitable type of connector.

The second end portion 14 of the connector 10 includes a head 24. The head 24 may be formed of any suitable electrically conductive material such as steel, aluminum or copper. A contact passageway 26 is defined in the head 24. The contact passageway 26 defines a contact passageway axis A2, which is transverse to and, in some embodiments, perpendicular to or substantially perpendicular to the conductor bore axis A1. The contact passageway 26 is configured to receive a component (e.g., a plug member) to electrically connect the cable and electrical equipment, as will be described below.

In the illustrated embodiment, a plurality of resilient contact members 30 extend radially inwardly from an inner surface 28 of the contact passageway 26. The contact members 30 are configured to resiliently deform or deflect (i.e., toward the inner surface 28) when a component such as a plug member is received in the passageway 26 and urges against the contact members 30. The resilient contact members 30 may be springs. The resilient contact members 30 may be formed of any suitable electrically conductive material such as steel, aluminum or copper. The resilient contact members 30 may extend along at least a major portion of a length L of the contact passageway 26. The resilient contact members 30 may be omitted in some embodiments.

The connector 10 includes an electrically conductive semi-flexible joint 34 extending between the first portion 12 and the second portion 14 (i.e., between the body 16 and the head 24). The term "semi-flexible" means that the joint 34 has increased flexibility relative to the connector body 16 and head 24. The semi-flexible joint 34 may be formed of any suitable electrically conductive material such as steel, aluminum or copper. In some embodiments, the semi-flexible joint 34 consists of a single, flexible member. In some embodiments, the semi-flexible joint 34 includes multiple elongate elements (e.g., a multifilament member). The semi-flexible joint 34 or the material from which it is formed may have a Shore A hardness of between about 10 and 60. In some embodiments, the semi-flexible joint 34 has a Shore A hardness of about 60 or less.

A first end of the semi-flexible joint 34 is received in a bore 36 defined in the body 16. The bore 36 extends axially inwardly from a second end 40 of the body 16. A second, opposite end of the semi-flexible joint 34 is received in a bore 38 defined in the head 24. The bore 38 extends axially inwardly from a first end 42 of the head 24. In some embodiments, the semi-flexible joint 34 is soldered in the bore 38 and/or the bore 36.

The body 16 includes a partitioning wall 43 disposed between the bores 18 and 36. The partitioning wall 43 may be formed of any suitable electrically conductive material. The body 16 and the partitioning wall 43 may form a monolithic structure.

Figure 1B:
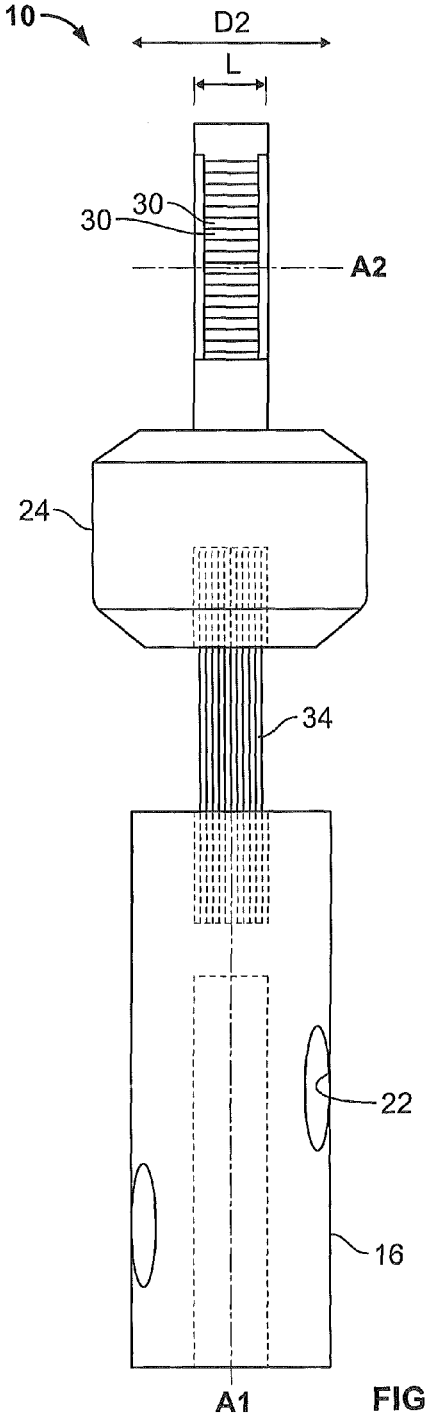
FIG. 1B is a side view of the cable connector of FIG. 1A.

The semi-flexible joint 34 may facilitate movement in the direction D1 (FIG. 1A) and/or the direction D2 (FIG. 1B), for example when a component such as a plug is received in the contact passageway 26.

Figure 3A:
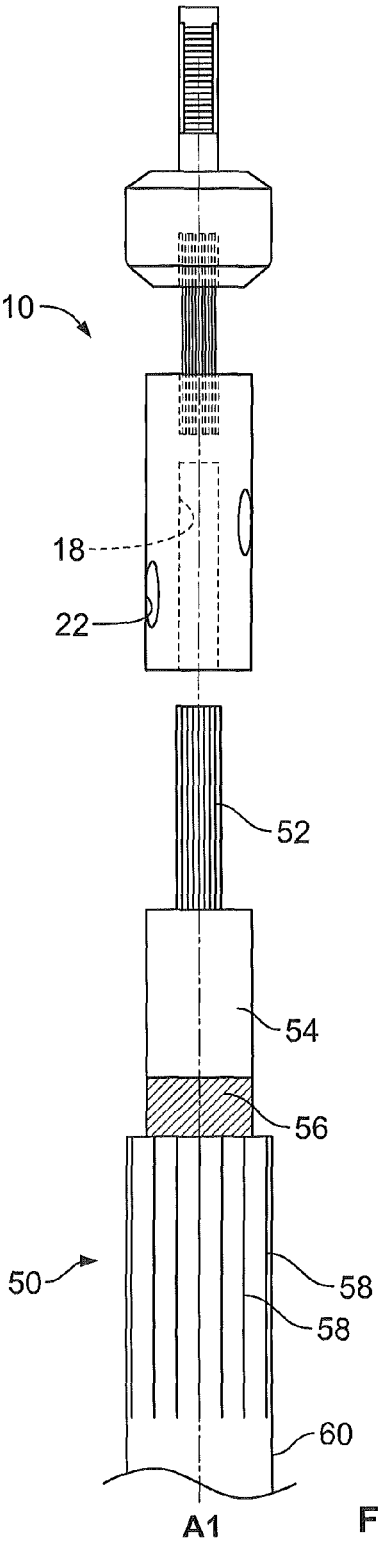
FIG. 3A illustrates the cable connector of FIGS. 1A and 1B and a cable according to some embodiments of the present invention.
Figure 3B:
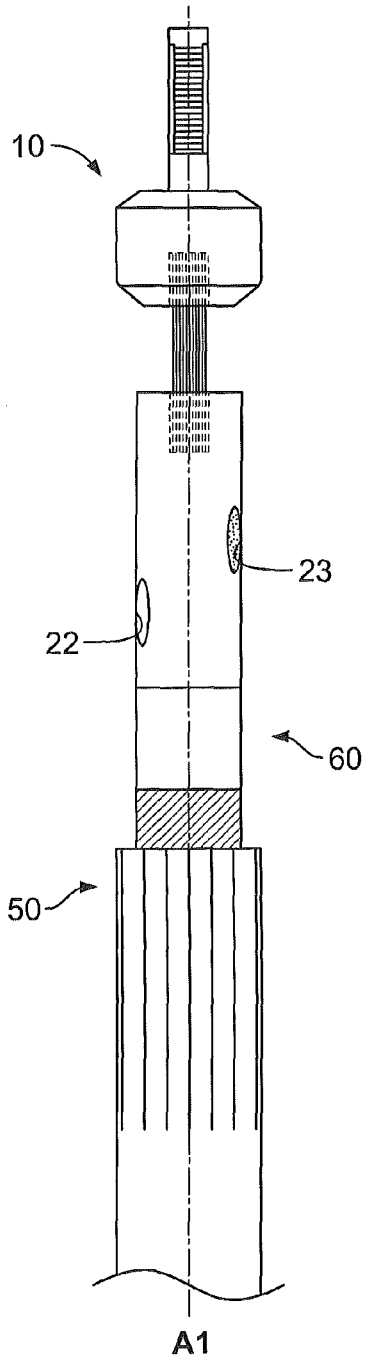
FIG. 3B illustrates the cable connector and cable of FIG. 3A as a terminated cable.

An exemplary cable 50 that may be used with the connector 10 and the system 101 is shown in FIG. 3A. The cable 50 includes a primary electrical conductor 52, a polymeric insulation layer 54, a semiconductor layer 56 and a jacket 60. The primary conductor 52 may be formed of any suitable electrically conductive materials such as copper (solid or stranded). The polymeric insulation layer 54 may be formed of any suitable electrically insulative material such as crosslinked polyethylene (XLPE) or EPR. The semiconductor layer 56 may be formed of any suitable semiconductor material such as carbon black with silicone. The jacket 60 may be formed of any suitable material such as EPDM or PVC.

According to some embodiments, the cable 50 is medium-voltage (e.g., between about 5 and 35 kV) or high-voltage (e.g., between about 46 and 230 kV) power transmission cables.

The cable is 50 prepared as shown in FIG. 3A such that a segment of each cable layer extends beyond the next overlying layer. Wires 58 from an electromagnetic shield layer are folded back onto the jacket 60. The wires 58 may be formed of any suitable material such as copper.

The connector 10 is mounted on the cable 50 such that the primary electrical conductor 52 is received in the conductor bore 18 along the conductor bore axis A1. The cable 50 is secured in the connector 10 using fasteners 23 (e.g., shear bolts) received in the bolt bores 22. The cable connector 10 and the cable 50 secured therein form a terminated cable 60.

Figure 4:
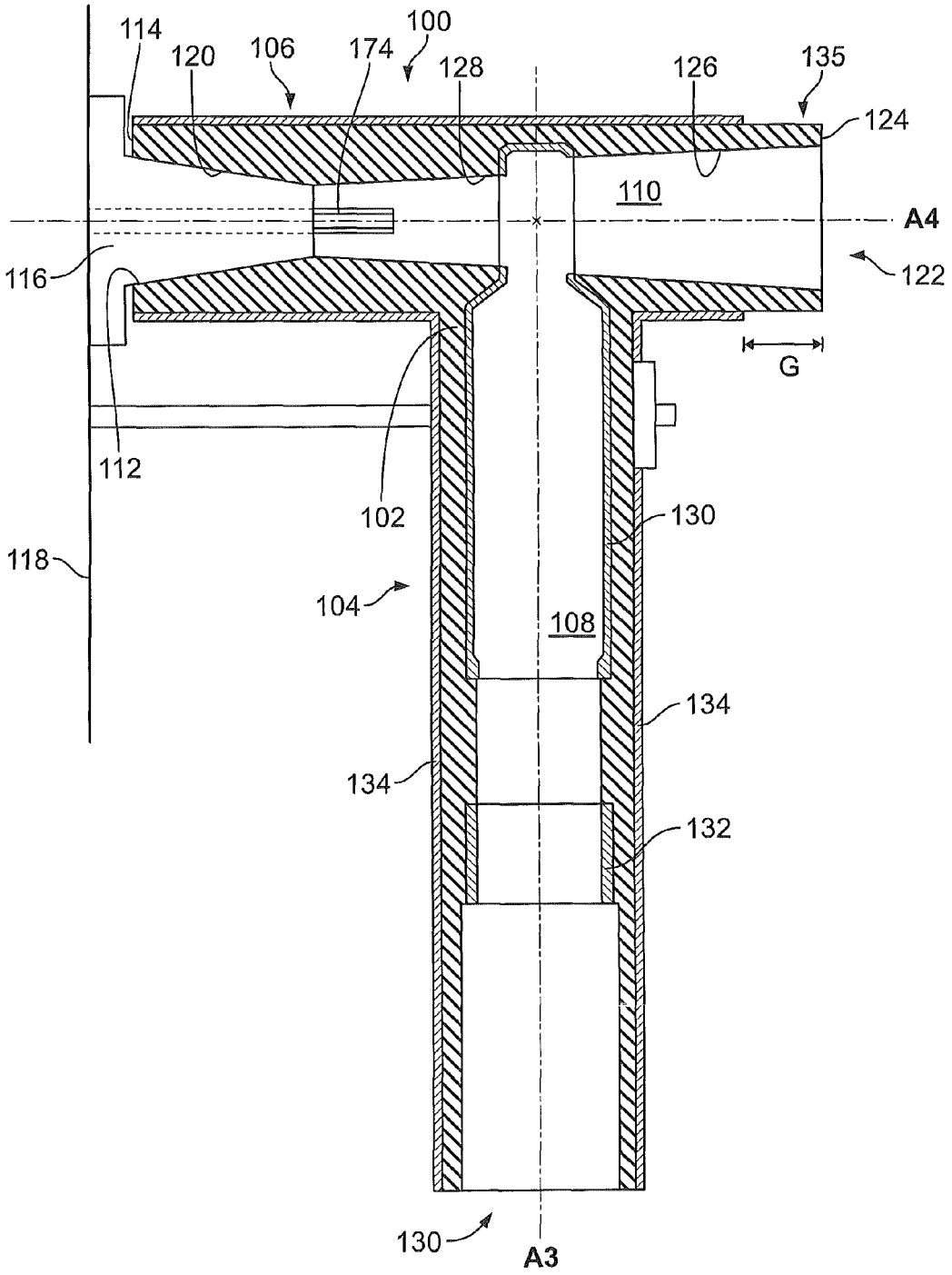
FIG. 4 is a sectional view of an adapter body according to some embodiments of the present invention.

Turning to FIG. 4, the adapter body 100 is T-shaped and has a tubular main leg 104 and a tubular cross leg 106. The legs 104, 106 define respective, intersecting inner passages 108, 110. The main leg passage 108 defines a main leg passage axis A3 and the cross leg passage 110 defines a cross leg passage axis A4. The cross leg 106 has a first opening 112 at a first end 114 of the cross leg 106. The first opening may receive a bushing 116 or other termination associated with electrical equipment 118 (e.g., switchgear, a transformer, etc.). The cross leg passage 110 includes a first portion 120 that tapers inwardly from the first end 114 of the cross leg 106. The first portion 120 is shaped and sized to receive the bushing 116 or other termination.

The cross leg 106 has a second opening 122 at an opposing second end 124 of the cross leg 106. The second opening 122 may receive a plug assembly, for example, as will be described in more detail below. Second and third portions 126, 128 of the passage 110 taper inwardly from the second end 124 of the cross leg 106. The second and third portions 126, 128 may be shaped and sized to receive various plug assemblies.

The main leg 104 includes an end opening 130 through which the cable connector 10 and/or the terminated cable 60 may be received along the main leg passage axis A3. As shown in FIG. 6A, the connector 10 may be press-fit in the adapter body 100 such that at least a portion of the head 24 of the connector 10 resides in the cross leg passage 110. Specifically, the connector 10 may be inserted in the adapter body 100 such that the contact passageway axis A2 (FIG. 1B) is parallel to or substantially parallel to and, in some embodiments, coincides or generally coincides with the cross leg passage axis A4 (FIG. 4).

According to some embodiments and as illustrated, the adapter body 100 has an electrical insulation layer 102. The insulation layer 102 may be formed of an elastomer. According to some embodiments, the insulation layer 102 is formed of EPDM. According to some embodiments, the insulation layer 102 is formed of LSR. Other suitable materials may include neoprene, silicone rubber or other rubber.

The adapter body 100 includes inner electrically conductive shield screens or layers 130, 132. The adapter body 100 includes an outer electrically conductive screen or layer 134. The screen layers 130, 132, 134 may be permanently bonded to the insulation layer 102. According to some embodiments, the screen layers 130, 132, 134 are formed of conductive EPDM or LSR. According to some embodiments, each layer 102, 130, 132, 134 has a Modulus at 100 percent elongation (M100) in the range of from about 0.65 to 3.5 MPa.

In some embodiments, and as shown in FIG. 4, the outer electrically conductive layer 134 does not extend to the second end 124 of the cross leg 106, thereby forming an axially extending, circumferential gap region G between the second end 124 and the electrically conductive screen layer 134. In the gap region G, a circumferential outer surface portion 135 of the insulation layer 102 is exposed.

Figure 5:
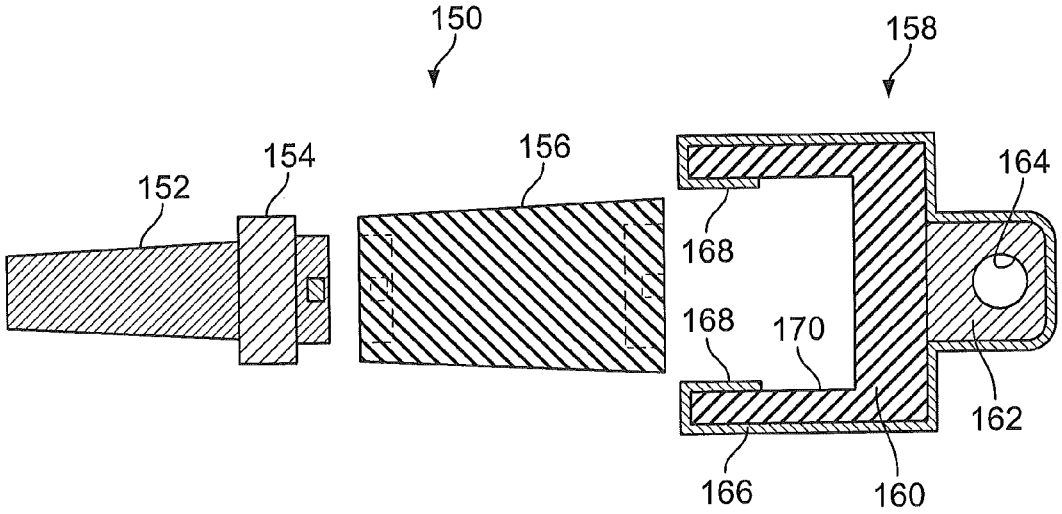
FIG. 5 is an exploded, sectional view of a plug assembly and a cap assembly according to embodiments of the present invention.

An exploded view of a plug assembly 150 according to some embodiments is illustrated in FIG. 5 along with a cap assembly 158. The plug assembly 150 includes an electrically conductive plug member 152 and an electrically insulating plug member 156. The electrically conductive plug member 152 includes an electrically conductive raised contact member 154, which is configured to reside within the contact passageway 26 of the connector 10, as will be discussed below. The electrically insulating plug member 156 is configured to electrically insulate an end face of the electrically conductive plug member 152.

The cap assembly 158 includes an electrically insulating body 160 and a tab 162. An aperture 164 is defined in the tab 162. An electrically conductive shield screen or layer 166 is provided on an outer surface of the body 160 and tab 162. In some embodiments, and as illustrated in FIG. 5, the electrically conductive screen layer 166 wraps around the cap body 160 such that a portion 168 of the electrically conductive screen layer 166 is disposed on an inner surface 170 of the cap body 160.

The cap body 160 may be formed of an elastomer. According to some embodiments, the cap body 160 is formed of EPDM. According to some embodiments, the cap body 160 is formed of LSR. Other suitable materials may include neoprene, silicone rubber or other rubber. The screen layer 166 may be permanently bonded to the cap body 160 and/or the tab 162. According to some embodiments, the screen layer 166 is formed of conductive EPDM or LSR.

Figure 8A:
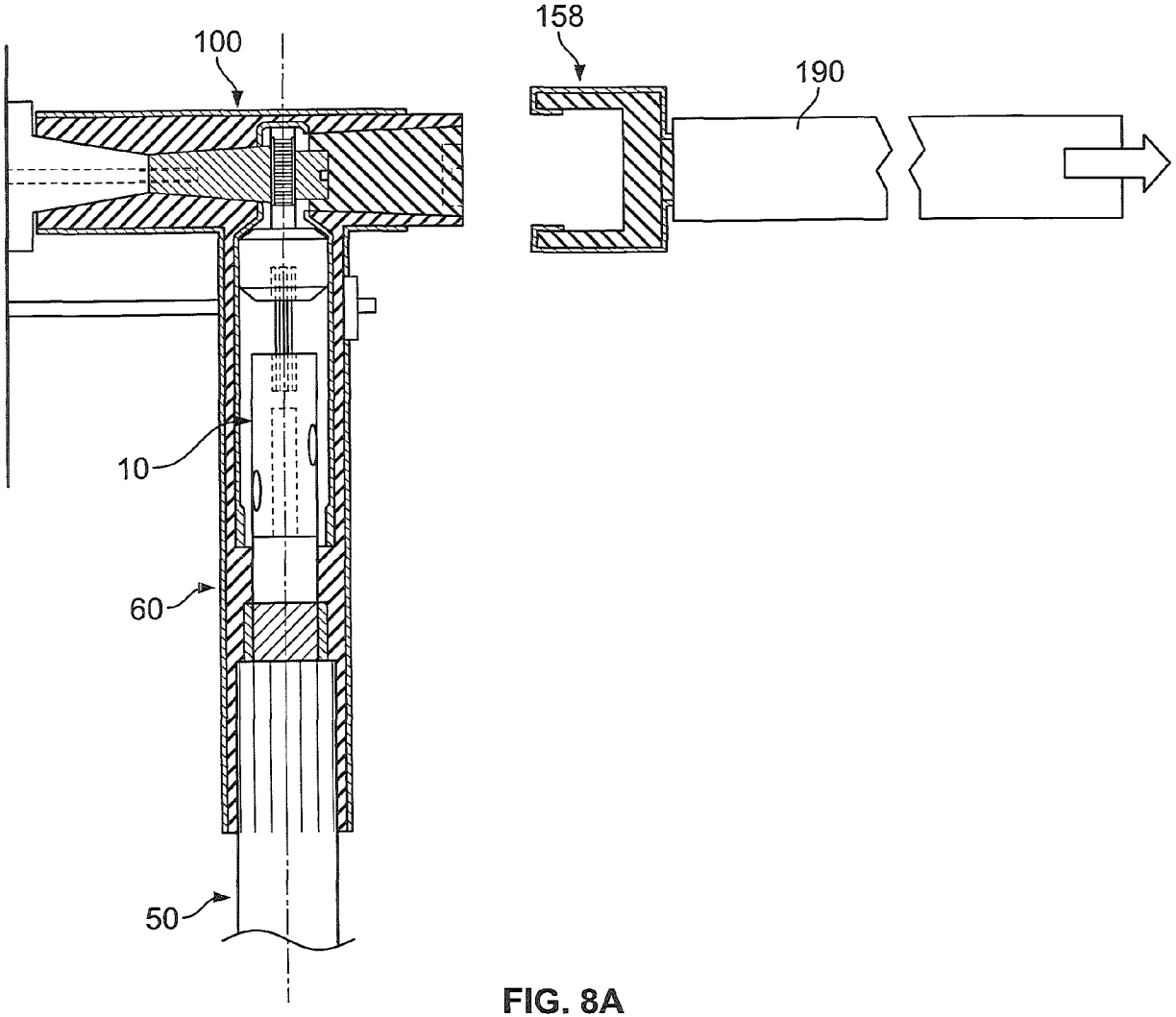
FIGS. 8A-8G are schematic drawings illustrating exemplary operations according to embodiments of the present invention.
Figure 8B:
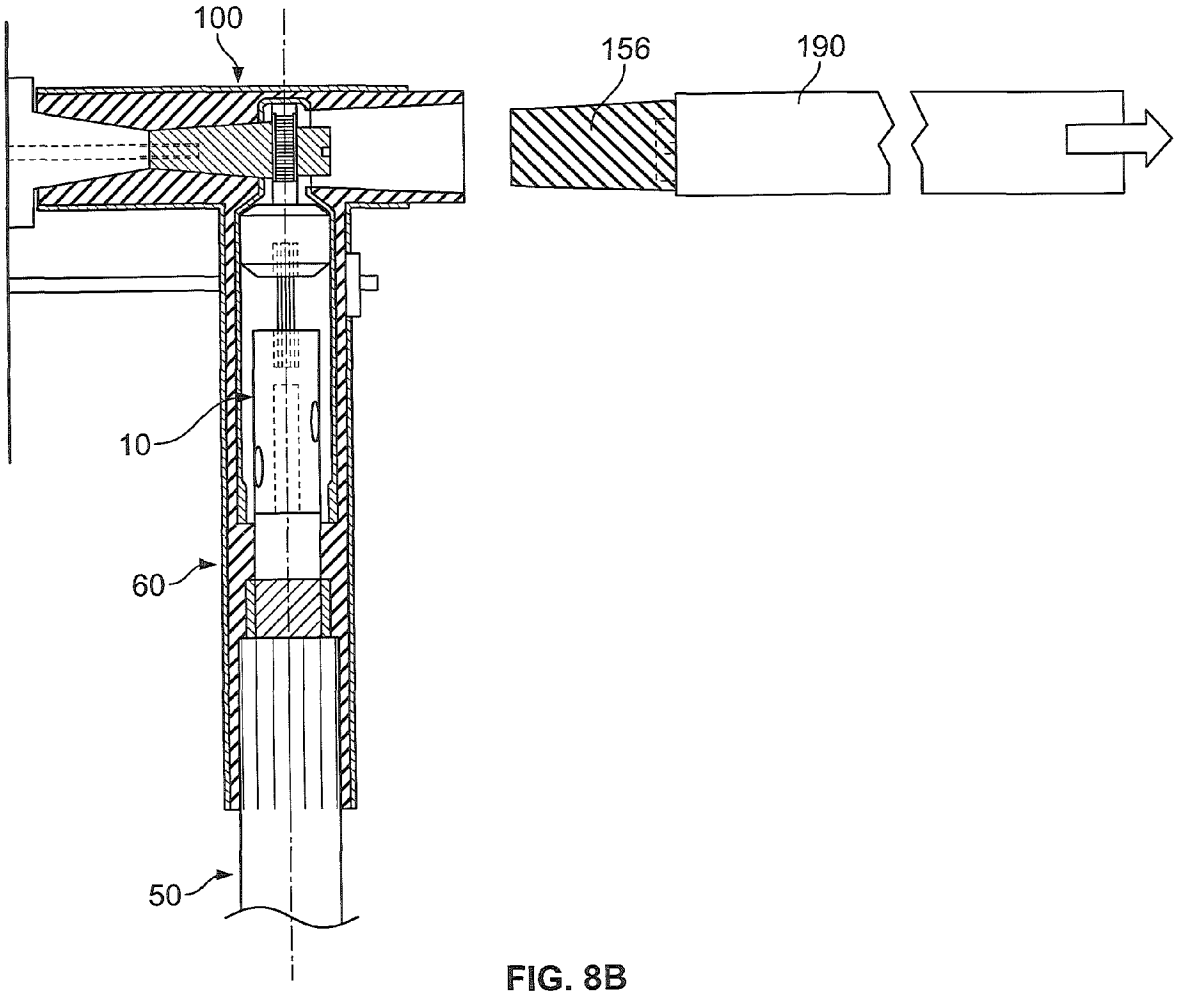

Turning now to FIG. 6A, the connector 10 and/or the terminated cable 60 may be received through the end opening 130 and push-fit into the adapter body 100. Specifically, the connector 10 and/or the cable 50 may be pushed through the main leg passage 108 until a portion of the head 24 of the connector 10 extends into the cross leg passage 110 (this configuration is also shown in FIG. 8D). The head 24 is positioned such that the contact passageway 26 (FIG. 1A) is disposed in the cross leg passage 110. The electrically conductive screen layer 130 encloses or surrounds the connector 10 within a Faraday cage. The electrically conductive screen layer 132 may serve as a stress cone layer to redistribute the voltage along the surface of the cable insulation 54 to reduce or prevent the degradation of the insulation 54 that might otherwise occur.

Thereafter, the plug assembly 150 is inserted through the second opening 122 and into the cross leg passage 110. In the embodiment shown in FIG. 6A, an aperture 176 of the electrically conductive plug member 152 receives a pin 174 of the bushing 116. The raised contact member 154 of the electrically conductive plug member 152 (FIG. 5) is received in the contact passageway 26 of the connector 10. The semi-flexible joint 34 may facilitate alignment of the electrically conductive plug member 152 and/or the plug assembly 150 as it is installed in the cross leg passage 110. Specifically, the semi-flexible joint 34 may allow the head 24 of the connector 10 to move in the directions D1 and D2 (FIGS. 1A and 1B) as the raised contact member 154 of the electrically conductive plug member 152 is seated within the contact passageway 26 of the head 24. Where used, the resilient contact members 30 (FIG. 1A) may provide additional flexibility to further facilitate alignment. Some of the resilient contact members 30 may deflect inwardly toward the contact passageway inner surface 28 more than other of the resilient contact members 30.

The semi-flexible joint 34 and/or the resilient contact members 30 can accommodate misalignment of the contact passageway 26 and the raised contact member 154 of the electrically conductive plug member 152 due to installation variance and/or manufacturing tolerances, for example. Thus, the semi-flexible joint 34 and/or the resilient contact members 30 may facilitate self-alignment of the electrically conductive plug member 152 as it is installed in the cross leg passage 110 and as the aperture 176 of the electrically conductive plug member 152 receives the pin 174 of the equipment bushing 116. The semi-flexible joint 34 may allow the head 24 to have limited movement or "float" in the passage 110.

Also shown in FIG. 6A is a fixation member 180 that may help mechanically secure the adapter body 100 to the equipment 118. In this regard, the adapter body 100 and components installed therein do not simply rely on the mechanical connection provided by the pin 174 of the bushing 116. The fixation member 180 may be secured to the main leg 104 by any suitable attachment or connection; for example, a bracket 182 may be provided on the main leg 104. The bracket 182 may be an L-bracket or a bracket with curvature to match the contour of the main leg 104.

With the cap assembly 158 installed, the electrically conductive screen layer 134 on the adapter body cross leg 106 extends to and makes physical and electrical contact with the electrically conductive screen layer portion 168 on the inner surface 170 of the cap body 160. This overlapping area is shown at 184 in FIG. 6A. This arrangement helps to ensure continuity of the conductive layers from the adapter body 100 to the cap assembly 158. When the cap assembly 158 and/or the plug assembly 150 are removed, the exposed outer surface portion 135 of the insulation layer 102 may provide improved electrical breakdown performance as the insulating path from live to earth is longer. As will now be further described, such an arrangement may provide for improved ease and safety of access to the electrical connection between the cable 50 and the electrical equipment 118.

Safety and legal requirements related to accessing high voltage connection points including those described above may create difficulties in accessing such locations to change configurations, perform tests and the like. The configuration shown in FIG. 6A may improve both the ease and safety of such access, for example using operations described below.

First, the power of the equipment 118 is switched off. As shown in FIG. 8A, a technician may then use a hot stick 190 to remove the cap assembly 158. The hot stick 190 may engage the aperture 164 of the tab 162 (FIG. 5). The cap assembly 158 may be safely removed due to the full screening of the cap assembly 158. The technician may next use the hot stick 190 to remove the electrically insulating plug member 156, as shown in FIG. 8B.

Figure 8C:
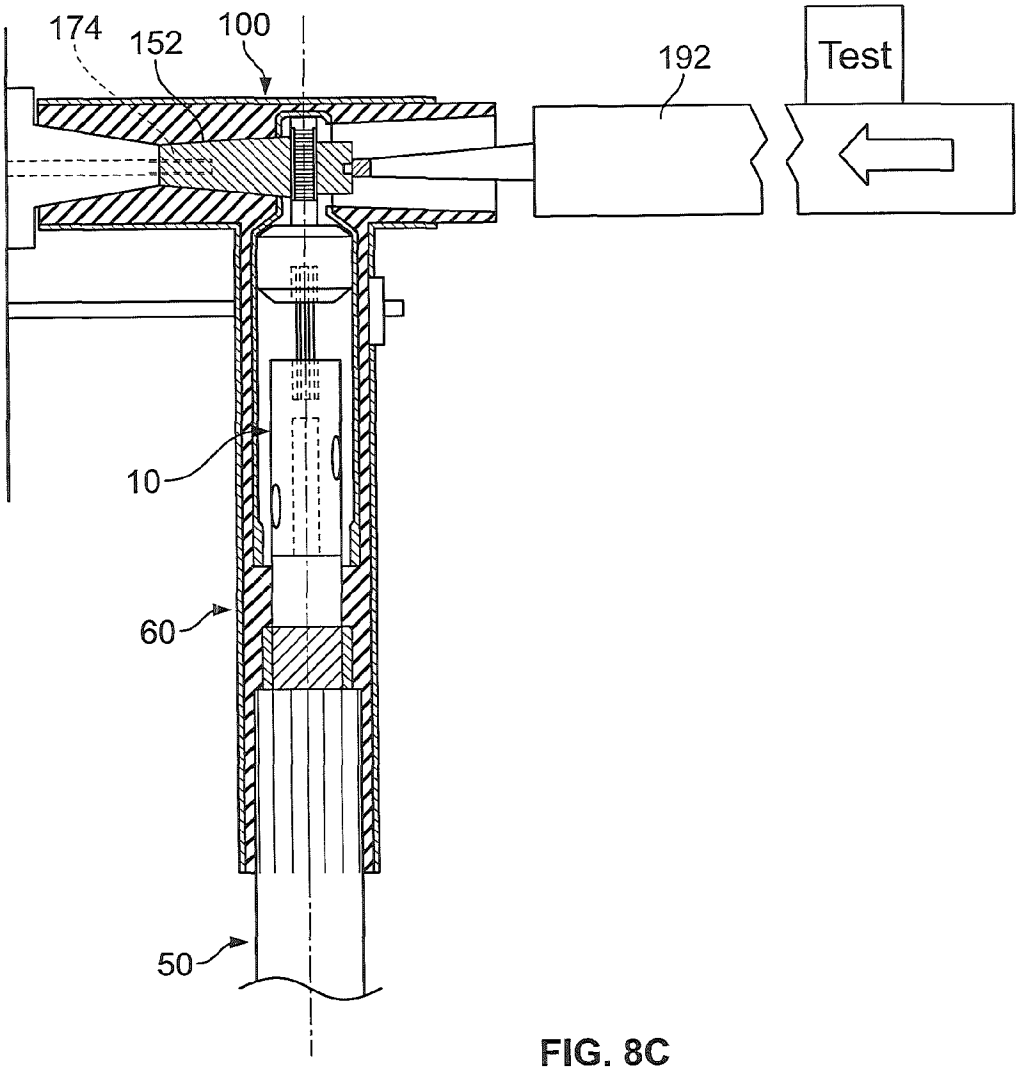
Figure 8D:
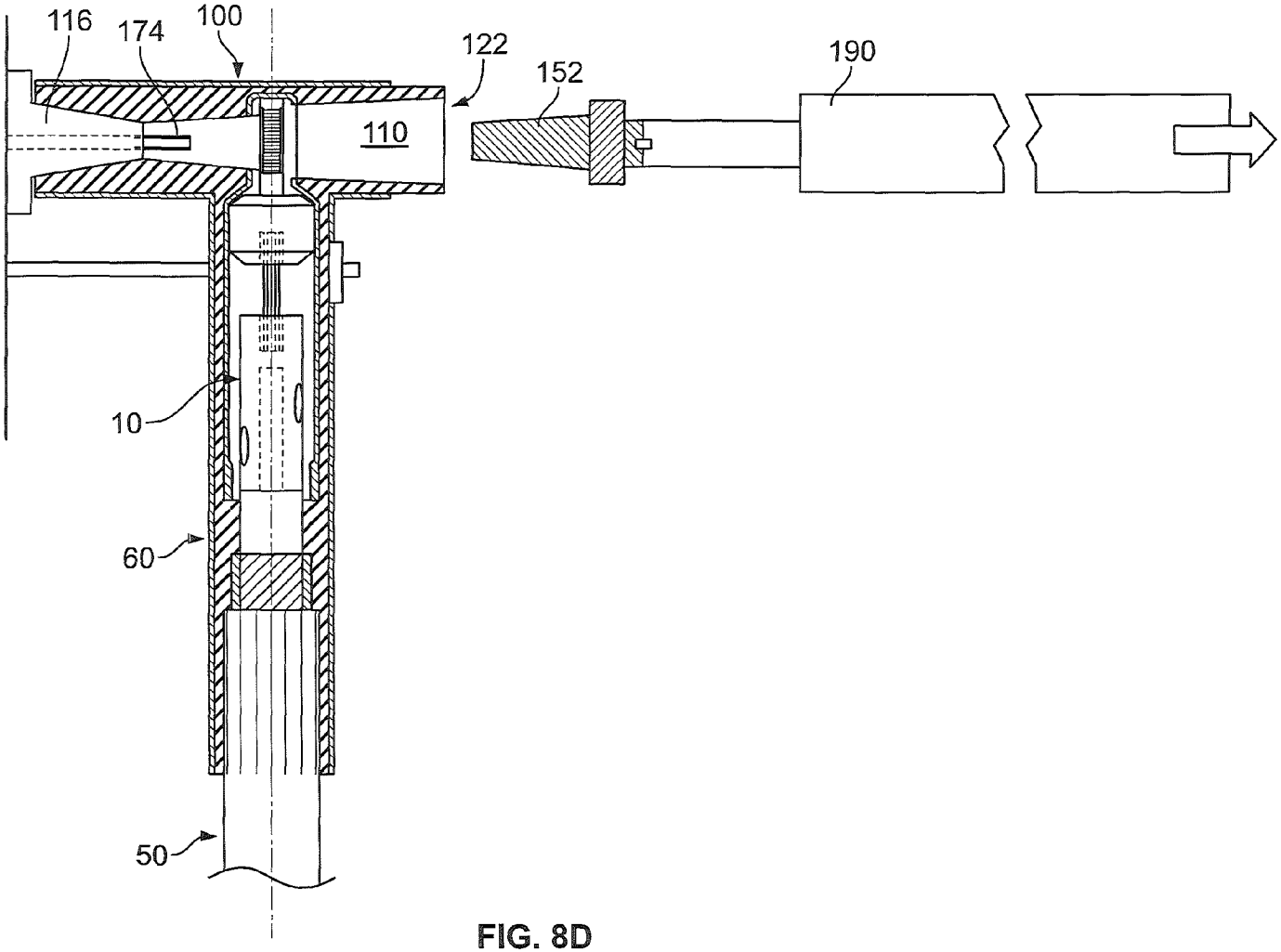

After removing the electrically insulating plug member 156, the technician may use a voltage test device 192 to confirm that the power is off, as shown in FIG. 8C. The voltage test device 192 contacts the electrically conductive plug member 152 to confirm a voltage level of the electrically conductive plug member 152 and to determine whether it is safe to remove the electrically conductive plug member 152. This testing is based on a live metal connection as the electrically conductive plug member 152 is directly connected to the pin 174 of the equipment bushing 116 and is electrically connected to the cable 50 by the connector 10. This testing based on a live metal connection is generally more reliable than capacitive coupling.

Once the test confirms it is safe to remove the electrically conductive plug member 152, the electrically conductive plug member 152 may be removed using the hot stick 190, as shown in FIG. 8D. At this point, a number of different plug assemblies for different grounding or testing configurations may then be inserted through the opening 122 and into the passage 110. Exemplary plug assemblies are shown in FIGS. 7A-7D.

Figure 7A:
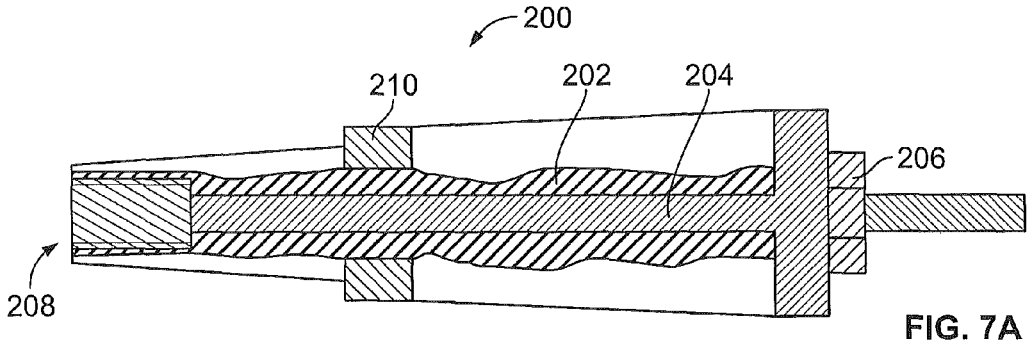
FIGS. 7A-7D are sectional views of various plug assemblies according to embodiments of the present invention.

An equipment earthing plug 200 is illustrated in FIG. 7A. The equipment earthing plug 200 includes an electrically insulating portion 202 and an electrically conductive portion 204 that extends from a grounding receptacle 206 (e.g., a hexagonal nut) to an aperture 208 that is configured to receive the equipment bushing pin 174 (FIG. 8D). The equipment earthing plug 200 allows for grounding the equipment bushing pin 174 without grounding the cable 50 (FIG. 8D). The electrically insulating portion 202 electrically isolates the contact member 210 (received in the contact passageway 26 of the connector 10, see FIG. 1A) from the electrically conductive portion 204.

Figure 7B:
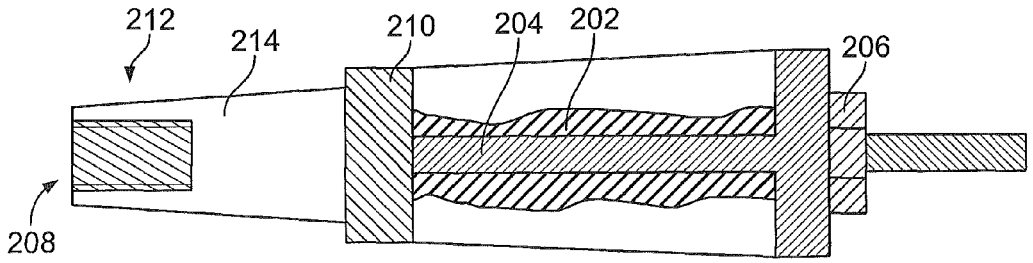

A cable earthing plug 212 is shown in FIG. 7B. The electrically conductive portion 204 extends from the grounding receptacle 206 to the contact member 210. A second electrically insulating portion 214 is provided between the aperture 208 and the contact member 210. The cable earthing plug 212 allows for grounding of the cable without grounding of the equipment bushing pin 174.

Figure 7C:
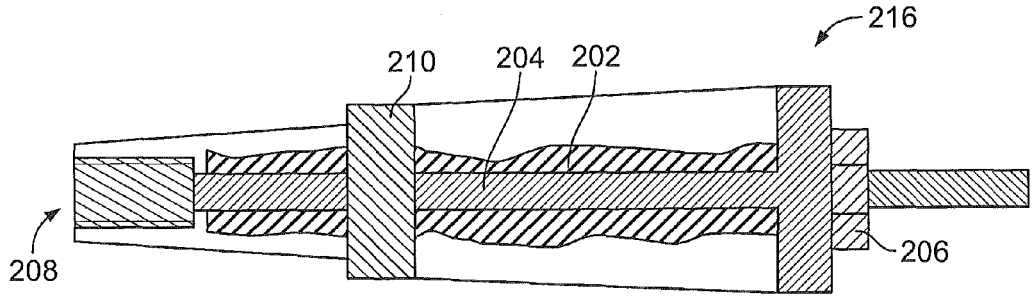

The equipment earthing plug 200 and the cable earthing plug 212 serve to electrically isolate the equipment and the cable such that one or the other may be grounded. A cable and equipment earthing plug 216 is illustrated in FIG. 7C. The electrically insulating portion 202 does not serve to electrically isolate the contact member 210 from the electrically conductive portion 204. As such, the cable and equipment earthing plug 216 allows for grounding the equipment bushing pin 174 and grounding the cable 50.

Figure 7D:
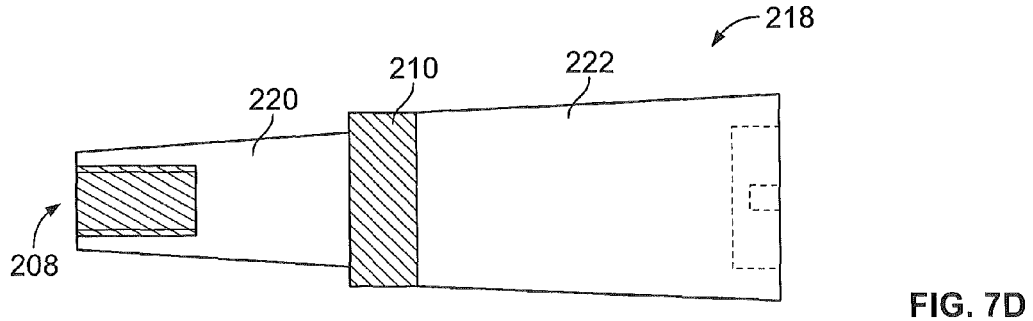

Finally, as shown in FIG. 7D, an insulating plug 218 may be provided. The insulating plug 218 includes electrically insulating portions 220, 222 to electrically isolate both the equipment bushing pin 174 and the cable 50.

Figure 8E:
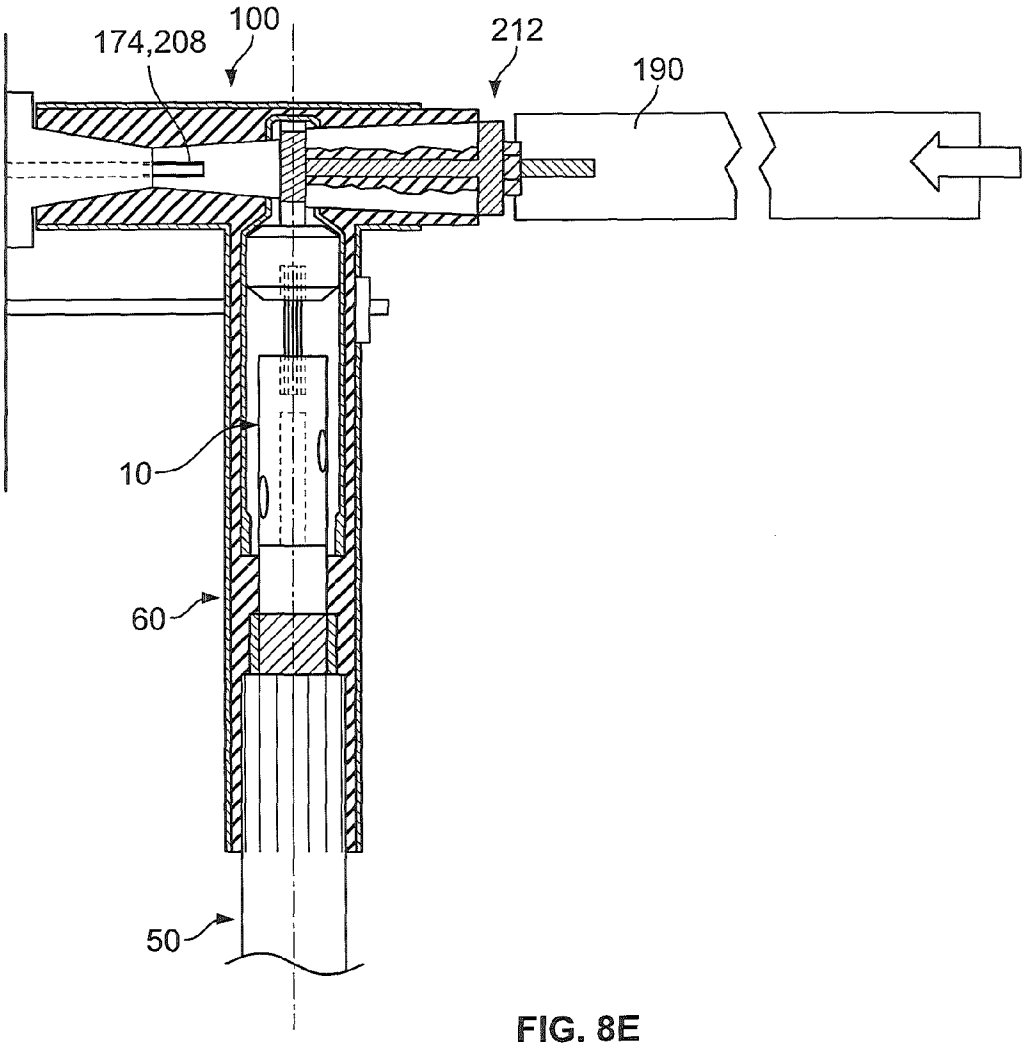
Figure 8F:
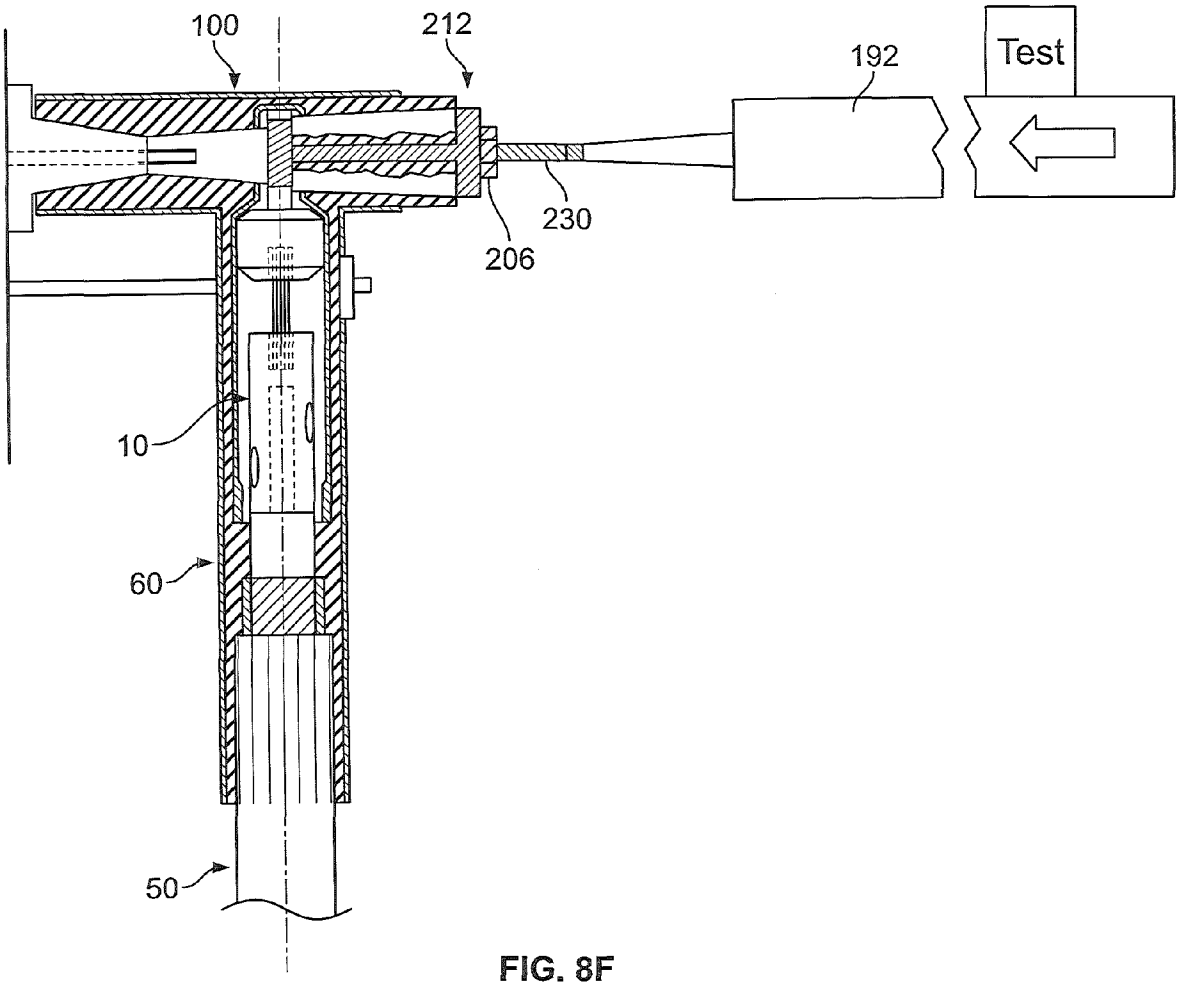
Figure 8G:
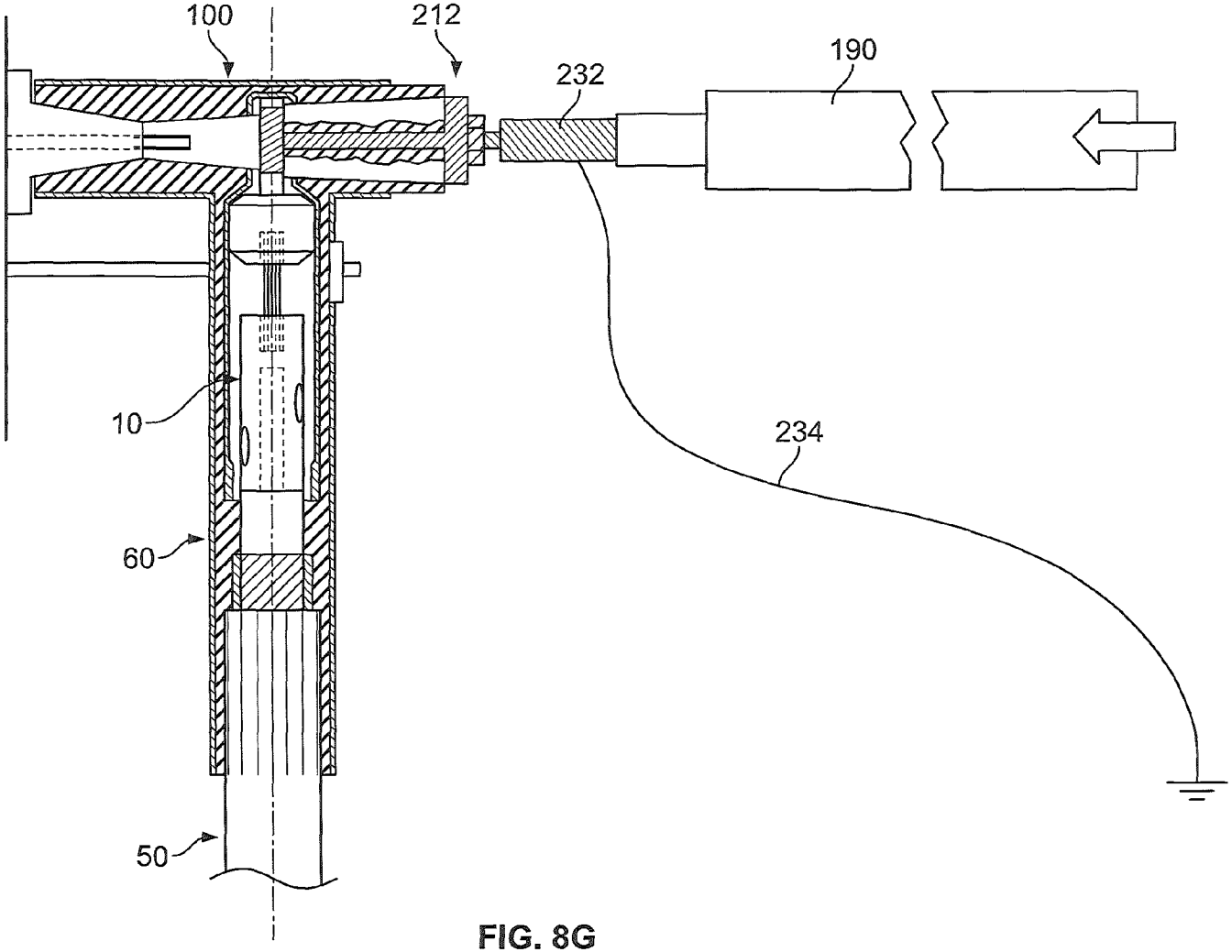

Referring to FIG. 8E, the hot stick 190 may be used to insert the cable earthing plug 212 into the adapter 100 such that the equipment bushing pin 174 is received in the aperture 208. The contact member 210 (FIG. 7B) is received in and contacts the contact passageway 26 of the connector 10 (FIG. 1A). The voltage test device 192 may be used to contact the receptacle 206 or a pin 230 extending therefrom (e.g., to confirm that the power is off) as illustrated in FIG. 8F. As shown in FIG. 8G, the hot stick 190 may be used to connect an earthing device 232 including a cable/wire 234 extending therefrom to ground the cable 50.

Figure 2A:
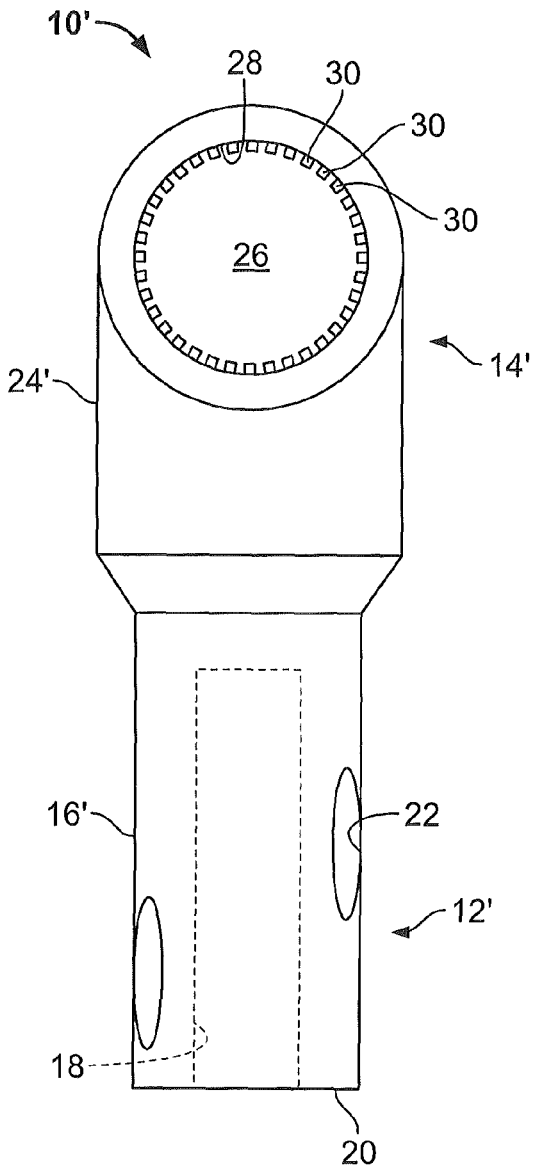
FIG. 2A is front view of a cable connector according to some other embodiments of the present invention.
Figure 2B:
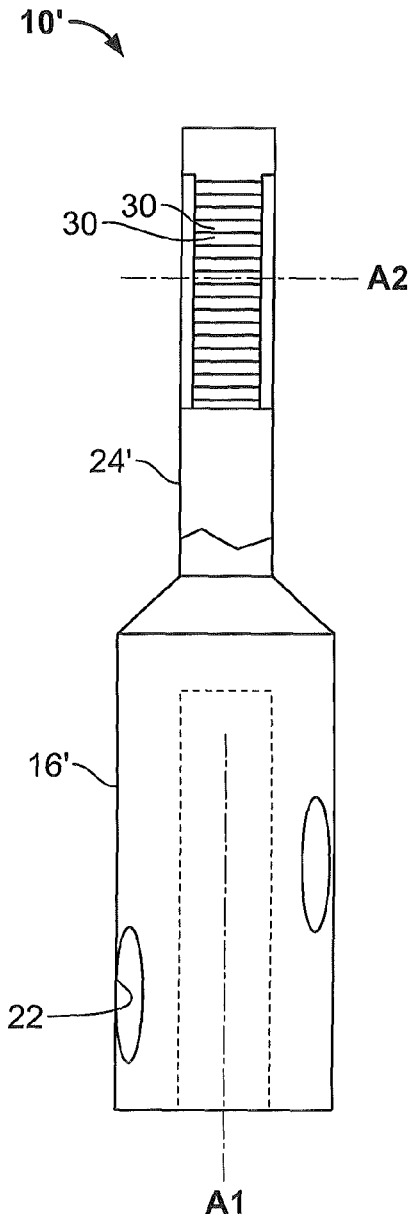
FIG. 2B is a side view of the cable connector of FIG. 2A.
Figure 3C:
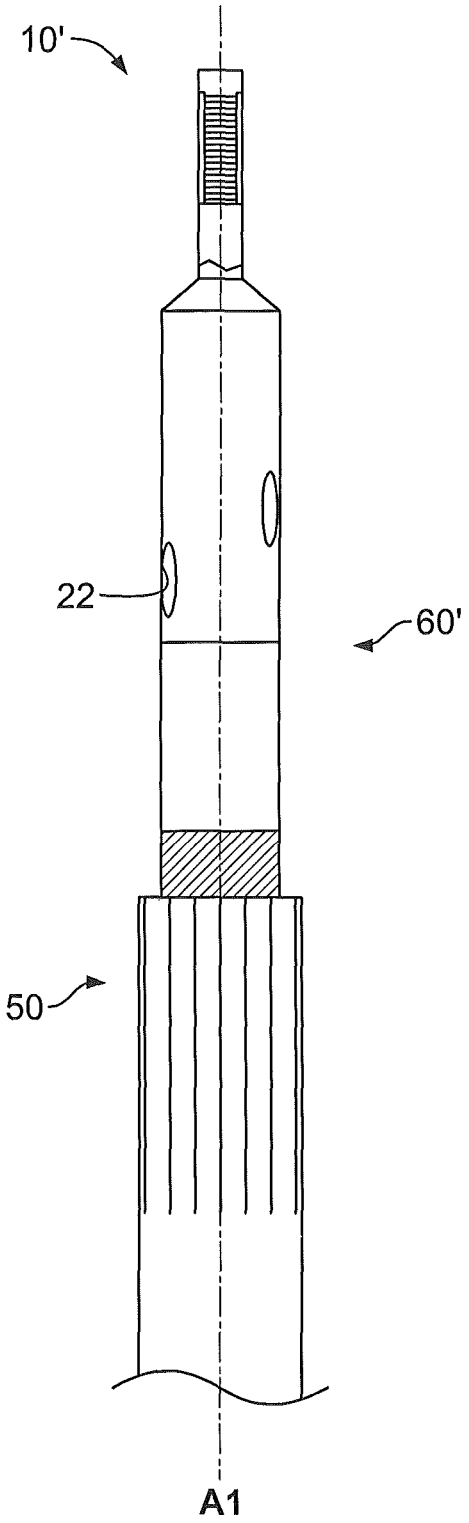
FIG. 3C illustrates the cable connector of FIGS. 2A and 2B and a cable as a terminated cable according to some embodiments of the present invention.
Figure 6B:
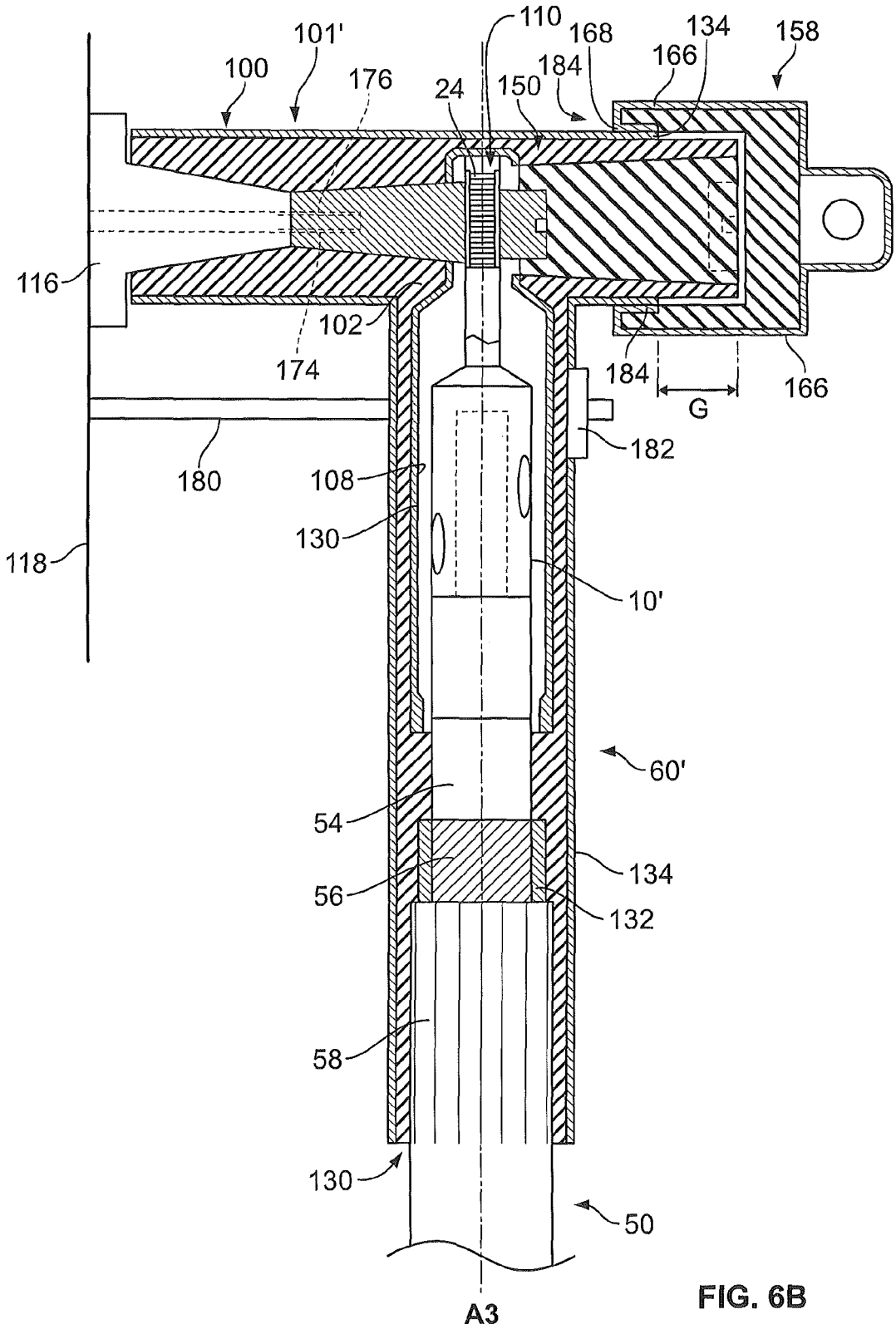
FIG. 6B is a fragmentary, sectional view of a cable connection system including the cable connector of FIGS. 2A and 2B according to embodiments of the present invention.

A cable connector 10' according to some other embodiments is shown in FIGS. 2A and 2B. The connector 10' includes a first end portion 12' including a body 16' and a second end portion 14' including a head 24'. The first and second end portions 12', 14', the body 16' and the head 24' may be configured in the same manner as the end portions 12, 14, the body 16 and the head 24 of the connector 10 except a semi-flexible joint does not extend between the first and second end portions 12', 14'. The body 16' and the head 24' of the connector 10' may form a monolithic structure. FIG. 3C illustrates the connector 10' mounted on the cable 50. The connector 10' and the cable 50 secured therein form a terminated cable 60'. FIG. 6B shows a system 101' having the same general configuration as FIG. 6A but with the connector 10' and the cable 50 within the main leg passage 108.

Figure 9:
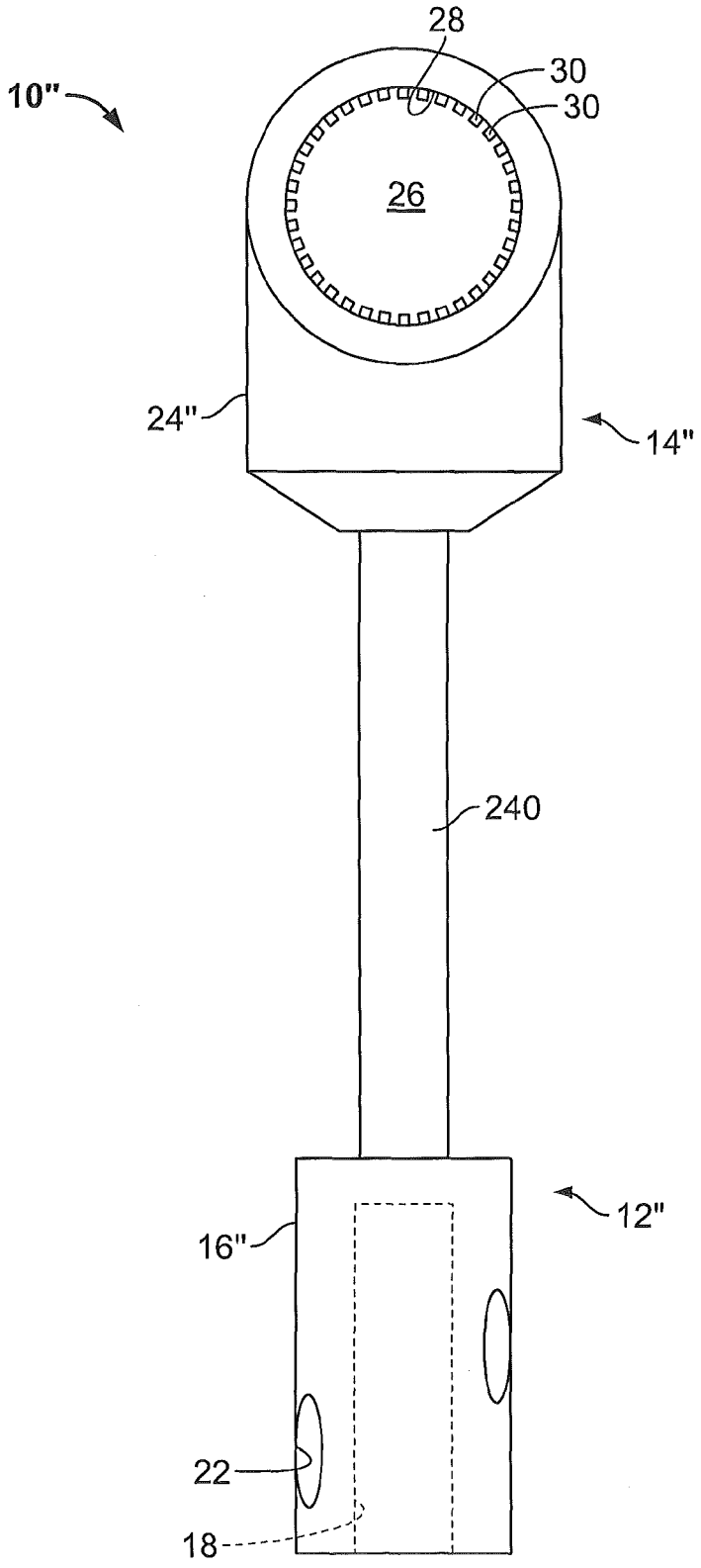
FIG. 9 is front view of a cable connector according to some other embodiments of the present invention.

A cable connector 10" according to further embodiments of the invention is illustrated in FIG. 9. The cable connector 10" includes first and second end portions 12", 14", body 16" and head 24". The first and second end portions 12", 14", body 16" and head 24" may be configured in the same manner as the end portions 12', 14', body 16' and head 24' of the connector 10' except as follows.

The cable connector 10" includes an electrically conductive elongated member extending 240 between the body 16" and the head 24". The elongated member 240 may be substantially rigid. In some embodiments, the body 16", the head 24" and the elongated member 240 form a monolithic structure. In some embodiments, the elongated member 240 is a semi-flexible member and allows for limited multi-dimensional movement of the head 24" as described above in connection with the connector 10 and the semi-flexible joint 34. In other embodiments, the elongated member 240 is substantially inflexible in service.

The connector 10" may be molded into a T-shaped adapter body 100'. The adapter body 100' may be configured in the same manner as the adapter body 100 except as follows. The adapter body 100' may include an inner electrically conductive screen or layer 242 that encloses or surrounds the elongated member 240 and/or the head 24" of the connector 10". The adapter body 100' may include an outer electrically conductive screen or layer 244 on the main leg 104 of the adapter body 100'.

Figure 10A:
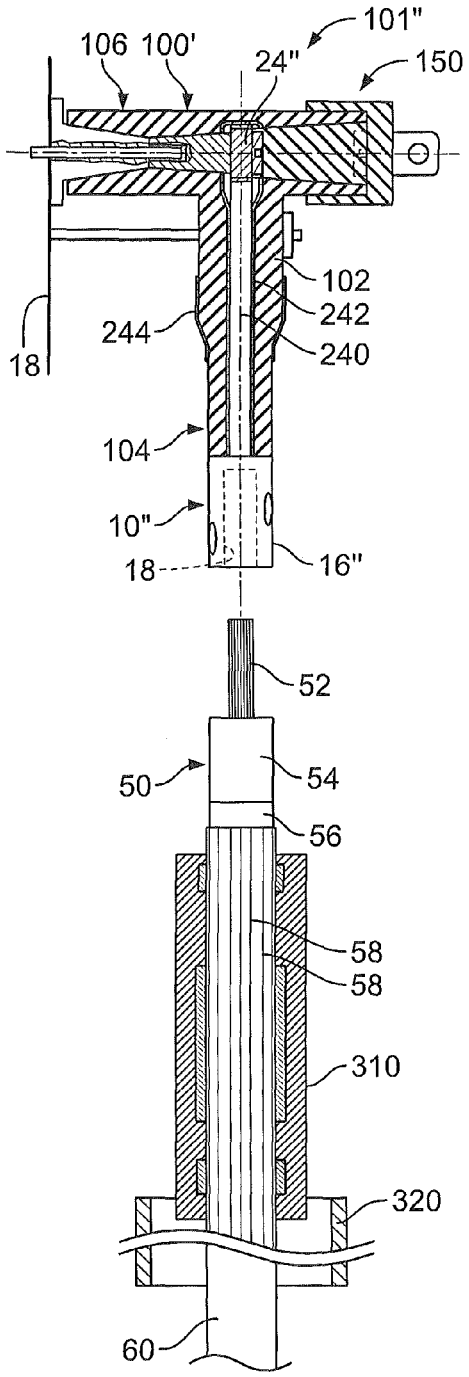
FIGS. 10A-10D are fragmentary, sectional views of a cable connection system including the cable connector of FIG. 9 according to embodiments of the present invention.
Figure 10B:
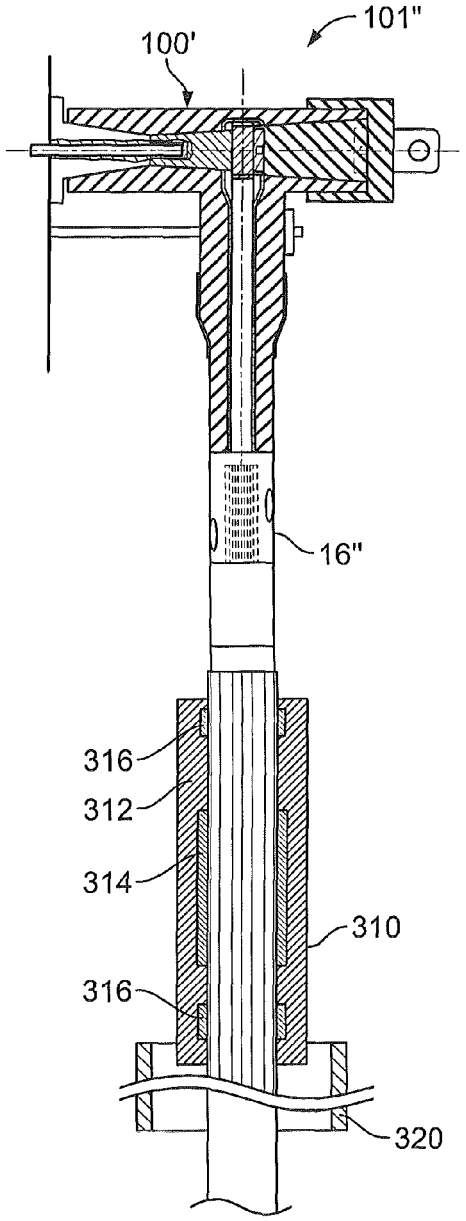

As illustrated, the body 16" of the connector 10" may be provided outside the adapter body 100'. As shown in FIGS. 10A and 10B, the primary electrical conductor 52 of the cable 50 may be received in the conductor bore 18 of the connector 10".

In some embodiments, a splice body 310 and an outer sleeve (or re-jacket) 320 are provided. As illustrated, a cable connection system 101" may include the connector 10", the adapter body 100', the cable 50, the splice body 310 and the outer sleeve 320.

The splice body 310 includes a primary insulation sleeve or layer 312, a tubular Faraday cage layer 314 and a pair of tubular stress cone layers 316. The primary insulation layer 312 is tubular and generally forms the bulk of the splice body 310 except for the Faraday cage layer 314 and the stress cone layers 316. According to some embodiments, the splice body 310 is unitarily molded.

The primary insulation layer 312 can be formed of any suitable material. According to some embodiments, the primary insulation layer 312 is formed of a dielectric or electrically insulative material. According to some embodiments, the primary insulation layer 312 is formed of an elastically expandable material. According to some embodiments, the primary insulation layer 312 is formed of an elastomeric material. According to some embodiments, the primary insulation layer 312 is formed of liquid silicone rubber (LSR). Other suitable materials may include EPDM or ethylene propylene rubber (EPR). According to some embodiments, the primary insulation layer 312 has a Modulus at 100 percent elongation (M100) in the range of from about 0.4 to 0.52 MPa.

Figure 10C:
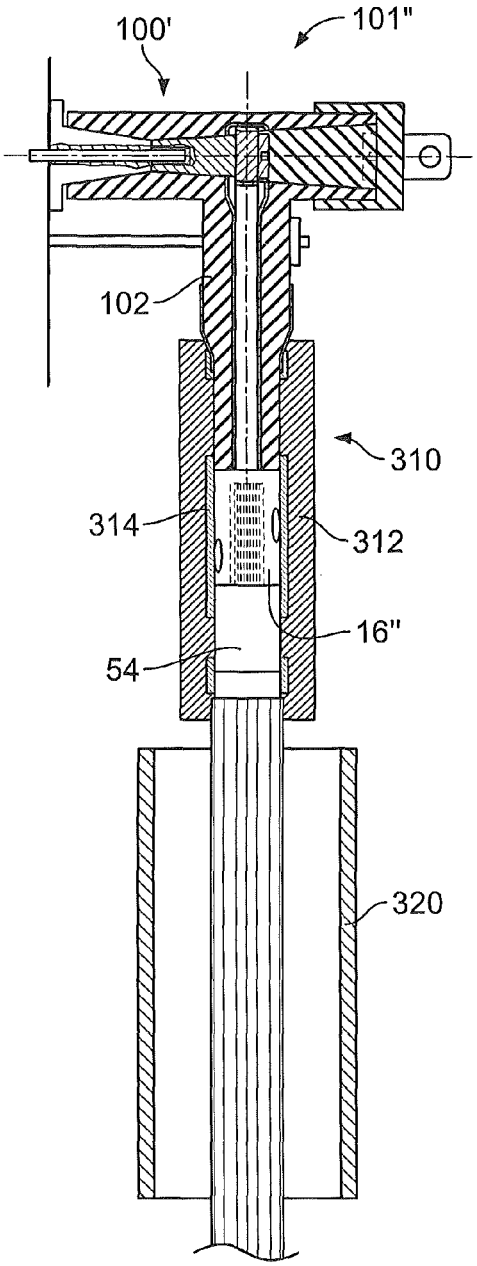
Figure 10D:
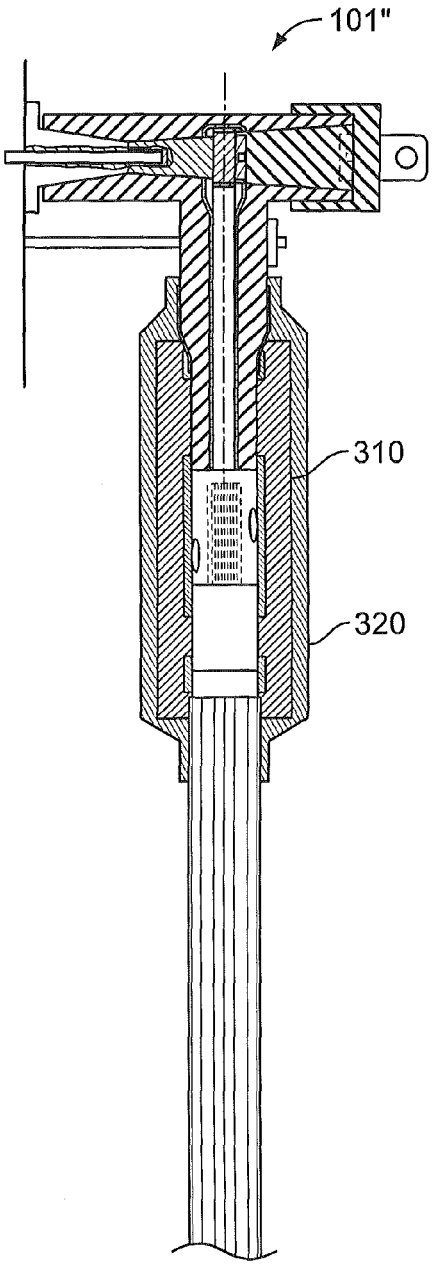

The Faraday cage layer 314 is a generally tubular sleeve bonded to the inner surface of the primary insulation layer 312. The Faraday cage layer 314 may be formed of a suitable elastically conductive elastomer. In use, and as shown in FIGS. 10C and 10D, the Faraday cage layer 314 may form a Faraday cage about the exposed body 16 of the connector 10".

The stress cone layers 316 are axially spaced apart, generally tubular sleeves bonded to the inner surface of the primary insulation layer 312 at opposing end portions of the splice body 310. The stress cone layers 316 may be formed of a suitable electrically conductive elastomer. In use, the stress cone layers 316 may serve to redistribute the voltage along the surface of the cable insulation 54 and/or the electrically insulating layer 102 of the adapter 100' to reduce or prevent the degradation of the insulation 60 and/or the electrically insulating layer 102 that might otherwise occur.

The outer sleeve 320 can be formed of any suitable material. According to some embodiments, the outer sleeve 320 is formed of an electrically insulative material. According to some embodiments, the outer sleeve 320 is formed of an elastically expandable material. According to some embodiments, the outer sleeve 320 is formed of an elastomeric material. According to some embodiments, the outer sleeve 320 is formed of ethylene propylene diene monomer (EPDM) rubber. Other suitable materials may include neoprene or other rubber. According to some embodiments, the outer sleeve 320 has a Modulus at 100 percent elongation (M100) in the range of from about 0.6 to 1.1 MPa. According to some embodiments, the outer sleeve 320 is unitarily molded.

According to some embodiments, the splice body 310 and/or the outer sleeve 320 are cold shrink covers, meaning that they can be shrunk or retracted to their final position without requiring the use of applied heat.

According to some embodiments, the splice body 310 and/or the outer sleeve 320 may be deployed using a holdout to radially contract and reach their final position.

Electrically conductive screens or layers may be provided as a layer of the splice body 310 or the outer sleeve 320 or may be applied to an outer surface of the adapter body 100'. The adapter body 100' and the cap assembly 150 may include electrically conductive screens or layers in the arrangement described above and as shown in FIGS. 6A and 6B, for example.

Although T-shaped adapters are described above, it is contemplated that elbow or L-shaped adapters may be used in connection with the connectors 10, 10', 10". For example, a plug may be integrated with the head 24, 24', 24" of the connectors 10, 10', 10", which may be disposed in an L-shaped adapter to electrically connect the cable and the electrical equipment.

The foregoing is illustrative of the present invention and is not to be construed as limiting thereof. Although a few exemplary embodiments of this invention have been described, those skilled in the art will readily appreciate that many modifications are possible in the exemplary embodiments without materially departing from the teachings and advantages of this invention. Accordingly, all such modifications are intended to be included within the scope of this invention as defined in the claims. The invention is defined by the following claims, with equivalents of the claims to be included therein.

That which is claimed is:

1. An adapter assembly for connecting an electrical conductor to a termination of electrical equipment, the assembly comprising:

an adapter body having a main leg with a main leg passage defined therein and a cross leg with a cross leg passage defined therein, wherein the main leg passage and the cross leg passage intersect; and a cable connector comprising:

an electrically conductive semi-flexible joint having first and second opposed joint ends;

a first end portion on the first joint end, the first end portion including a body configured to mechanically and electrically couple with an end of the conductor; and a second end portion on the second joint end, the second end portion including a head configured to directly or indirectly electrically connect the semi-flexible joint to the termination;

wherein the head is disposed in the cross leg passage and the semi-flexible joint is disposed in the main leg passage;

wherein the head has a contact passageway defined therein and a plurality of resilient contact members extending radially inwardly from an inner surface of the contact passageway, the contact passageway configured to receive and contact an electrically conductive component to electrically connect the conductor and the electrical equipment;

wherein the semi-flexible joint is configured to enable limited movement of the head in the cross leg passage when the electrically conductive component is received in and/or contacts the contact passageway.

2. The adapter assembly of claim 1, wherein the semi-flexible joint has greater flexibility than each of the body and the head.

3. The adapter assembly of claim 1, wherein the semi-flexible joint permits the head to move along an axis transverse to an axis of the cross leg passage.

4. The adapter assembly of claim 1, wherein the semi-flexible joint permits the head to move along an axis substantially parallel to an axis of the cross leg passage.

5. The adapter assembly of claim 1, wherein the body includes a bore holding the first joint end, and wherein the head includes a bore holding the second joint end.

6. The adapter assembly of claim 5, wherein each of the first and second joint ends is soldered in its respective bore.

7. The adapter assembly of claim 1, wherein the semi-flexible joint is a monolithic, substantially solid member.

8. The adapter assembly of claim 1, wherein the semi-flexible joint is a multifilament member.

9. The adapter assembly of claim 1, wherein at least some of the resilient contact members are configured to resiliently deflect when the component contacts the contact passageway.

10. The adapter assembly of claim 9, wherein the resilient contact members are springs.

11. The adapter assembly of claim 9, wherein each resilient contact member extends along at least a major portion of a length of the contact passageway.

12. The adapter assembly of claim 1, wherein:

the cross leg of the adapter body has a first end including a first end opening and an opposing second end including a second end opening, with the cross leg passage extending between the first and second end openings;

the first end opening is configured to receive a bushing of the electrical equipment; and the second end opening is configured to receive an electrically conductive plug assembly that contacts the contact passageway of the head and the bushing of the electrical equipment.

13. The adapter assembly of claim 1, wherein:

the cross leg of the adapter body has a first end including a first end opening and an opposing second end including a second end opening, with the cross leg passage extending between the first and second end openings; and the adapter body comprises an electrically insulating layer, wherein the cross leg of the adapter body comprises an electrically conductive layer on the electrically insulating layer, and wherein the electrically conductive layer extends from the first end of the cross leg to an intermediate point between the first end and the second end of the cross leg, thereby forming a gap without the electrically conductive layer between the intermediate point and the second end of the cross leg.

14. The adapter assembly of claim 13, further comprising a cap configured to connect over the second end of the cross leg, the cap including an electrically insulating cap body and an electrically conductive layer on an outer surface of the cap body and wrapping around to an inner surface of the cap body such that the electrically conductive layer is disposed on at least a portion of the inner surface, wherein, when the cap body is mounted on the second end of the cross leg, the electrically conductive layer on the inner surface of the cap body contacts the electrically conductive layer on the cross leg.

15. The adapter assembly of claim 1, wherein a portion of the second end portion of the cable connector is disposed in the main leg passage.

16. A cable connector for electrically connecting an electrical conductor to a termination of electrical equipment, the cable connector configured to be mounted in an adapter body having a main leg with a main leg passage and a cross leg with a cross leg passage that intersects the main leg passage, the cable connector comprising:

a first end portion including a body configured to mechanically and electrically couple with the conductor of a cable; and a second end portion opposite the first end portion including a head configured to indirectly electrically connect the conductor to the termination;

wherein the head is disposed in the cross leg passage when the cable connector is mounted in the adapter body;

wherein the head has a contact passageway defined therein, the contact passageway configured to receive and contact an electrically conductive component to electrically connect the cable and the electrical equipment when the cable connector is mounted in the adapter body;

wherein the cable connector further comprises a plurality of resilient contact members extending radially inwardly from an inner surface of the contact passageway, wherein at least some of the resilient contact members are configured to resiliently deflect inwardly toward the inner surface when the component contacts the contact passageway of the head.

17. The cable connector of claim 16, wherein:

the cable connector comprises an electrically conductive semi-flexible joint having first and second opposed joint ends;

the first end portion is on the first joint end;

the second end portion is on the second joint end;

the semi-flexible joint is disposed in the main leg passage when the cable connector is mounted in the adapter body; and the semi-flexible joint is configured to enable limited movement of the head in the cross leg passage when the cable connector is mounted in the adapter body and when the component contacts the contact passageway of the head.

18. The cable connector of claim 17, wherein the first end portion body is configured to mechanically and electrically couple with an end of the conductor.

19. An adapter assembly for connecting a cable to electrical equipment, the assembly comprising:

an T-shaped adapter comprising:

an electrically insulating body, the body including a main leg having a main leg passageway defined therein and a cross leg having a cross leg passageway defined therein that intersects with the main leg passageway, wherein the cross leg has first and second opposite ends; and a first electrically conductive layer on an outer surface of the electrically insulating body, the first electrically conductive layer extending along an entire length of main leg, the first electrically conductive layer extending from the first end of the cross leg to an intermediate point between the first and second ends, thereby forming a gap without the first electrically conductive layer between the intermediate point and the second end;

a cap configured to fit over the second end of the cross leg, the cap comprising:

an electrically insulating cap body; and a second electrically conductive layer on an outer surface of the cap body and wrapping around to an inner surface of the cap body such that the second electrically conductive layer is disposed on at least a portion of the inner surface;

wherein, when the cap is mounted on the second end of the cross leg, the second electrically conductive layer on the inner surface of the cap body contacts the first electrically conductive layer on the cross leg.

* * * * *